United States Patent [19]

Hoagland et al.

[11] Patent Number: 4,676,501

[45] Date of Patent: Jun. 30, 1987

[54] EXERCISE MACHINE

[75] Inventors: Daniel A. Hoagland, Robinson, Ill.; Michael J. Amoroso, R.R. 4, Box 232, Marion, Ill. 62959

[73] Assignee: Michael J. Amoroso, Marion, Ill.

[21] Appl. No.: 779,240

[22] Filed: Sep. 23, 1985

[51] Int. Cl.[4] ..... A63B 23/04

[52] U.S. Cl. ..... 272/70; 272/70.2; 272/134; 272/145; 272/900; 128/25 B

[58] Field of Search ..... 128/25 R, 25 B; 272/70, 272/70.2, 70.3, 73, 145, 900, 134, 136, 144

[56] References Cited

U.S. PATENT DOCUMENTS 2,815,020 12/1957 Barkschat ..... 128/25 B 3,625,203 12/1971 Wadelton ..... 128/25 B

*Primary Examiner*—Leo P. Picard

*Attorney, Agent, or Firm*—Cohn, Powell & Hind

[57] ABSTRACT

Apparatus (1) for providing physical exercise. The apparatus has first and second footpads (3,5) on which a person stands by placing one of his feet on each pad. An electric motor (17) is operable by the user to run the apparatus. A linkage (31, 31A) connects the motor to the pads to raise and lower the pads, the pads being moved simultaneously and in opposite directions. A pivot (63, 63A) acts with the linkage to adjust the amount of upward and downward movement of the foot pads and thereby the amount of exercise a person obtains. A stirrup attachment enables a seated person to use the machine.

20 Claims, 9 Drawing Figures

107
105
19
17
103
101
95
1
21
27
29
25
33A
23
4
93
33
31A
39A
97
75
63
31
131
35
99
67
87
35A
63A
67A
73
89
91
77
65A
81
39
65
71
69

EXERCISE MACHINE

BACKGROUND OF THE INVENTION

This invention relates to physical exercise equipment and more particularly to apparatus for providing exercise to persons of different ages and health conditions.

It is now generally accepted that most everyone should include exercise as part of their living routine. However, not everyong is able to engage in the same type of exercise. A young or robust individual should have strenuous exercise; a person recovering from a stroke or a heart attack gentler exercise; while a person with a condition, such as arthritis, limited exercise. Currently, several types of machines are used by the medical profession to provide these types of exercise. Examples of such machines are the treadmill and the exercycle. A drawback of these and similar machines is that the user must be able to run or physically move themselves. While this is not a problem for someone in good health, a person with a heart condition may not be able to run or use an exercycle. A person with arthritis may only have limited movement of their leg, hips or ankles. A bed or chair-ridden patient can't walk or stand and yet may still need to exercise to help maintain muscle tone and aid circulation. What is required is exercising equipment which is usable by the sickly as well as by the robust individual by the ambulatory as well as the bed-ridden person.

SUMMARY OF THE INVENTION

Among the several objects of the present invention may be noted the provision of apparatus for providing a person physical exercise; the provision of such apparatus for providing exercise by shifting a person's weight from one side to another; the provision of such apparatus for providing exercise to individuals whose health ranges from robust to bed-ridden; the provision of such apparatus in which the amount of exercise a person obtains can be controlled; the provision of such apparatus which is controlled by the person exercising to limit the amount of exercise they obtain and to prevent injury while using the apparatus; and the provision of such apparatus which is portable and whose operation is easy to understand.

Briefly, the apparatus of the present invention is apparatus for providing a person physical exercise by shifting the person's weight from one side to the other. The apparatus comprises first and second foot pads on which the person stands. The person places one of their feet on each respective pad. Each pad is capable of supporting a substantial portion of the peron's weight. An electric motor is operable by the person and a linkage connects the motor to the foot pads. The linkage raises and lowers each pad, the pads being moved simultaneously and in opposite direction. Movement of the pads shifts the person's weight from one side to the other. The apparatus also includes a pivot arrangement which acts with the linkage to adjust the amount of upward and downward movement of the footpads and thus the amount of exercise of the person.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
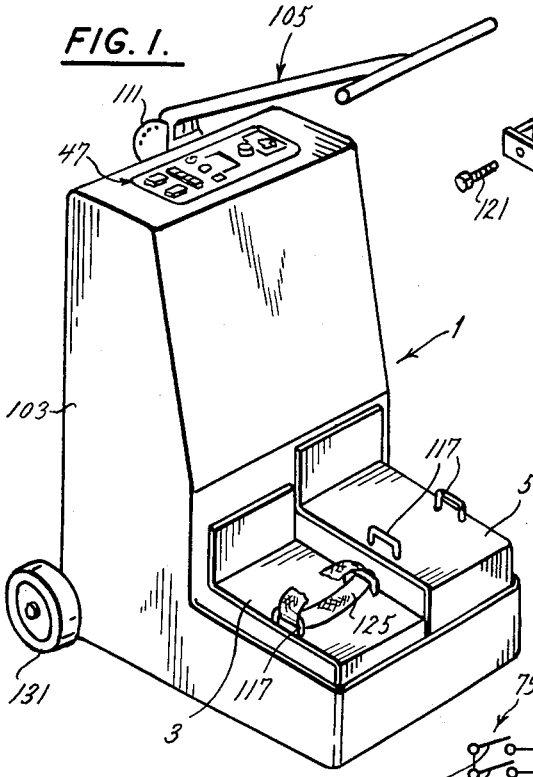
FIG. 1 is a perspective view of the exercise machine.
Figure 6:
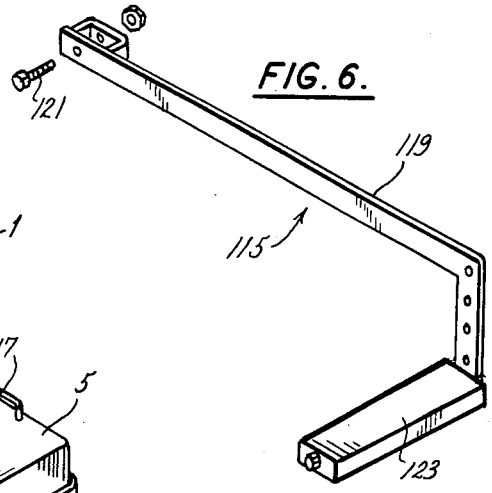
FIG. 6 is a perspective view of a stirrup attachment.
Figure 6:
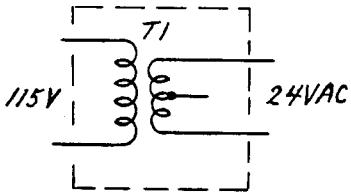
Figure 8:
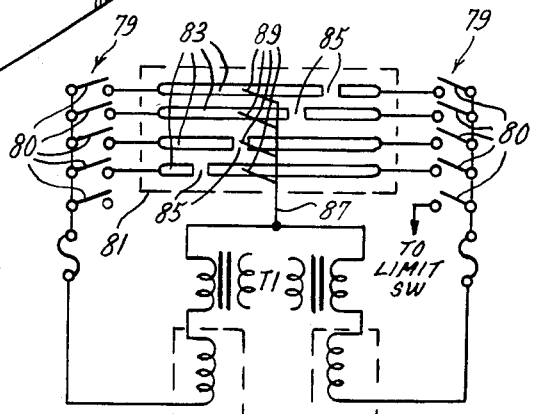
FIG. 8 is a supplemental schematic circuit diagram.
Figures 2, 5:
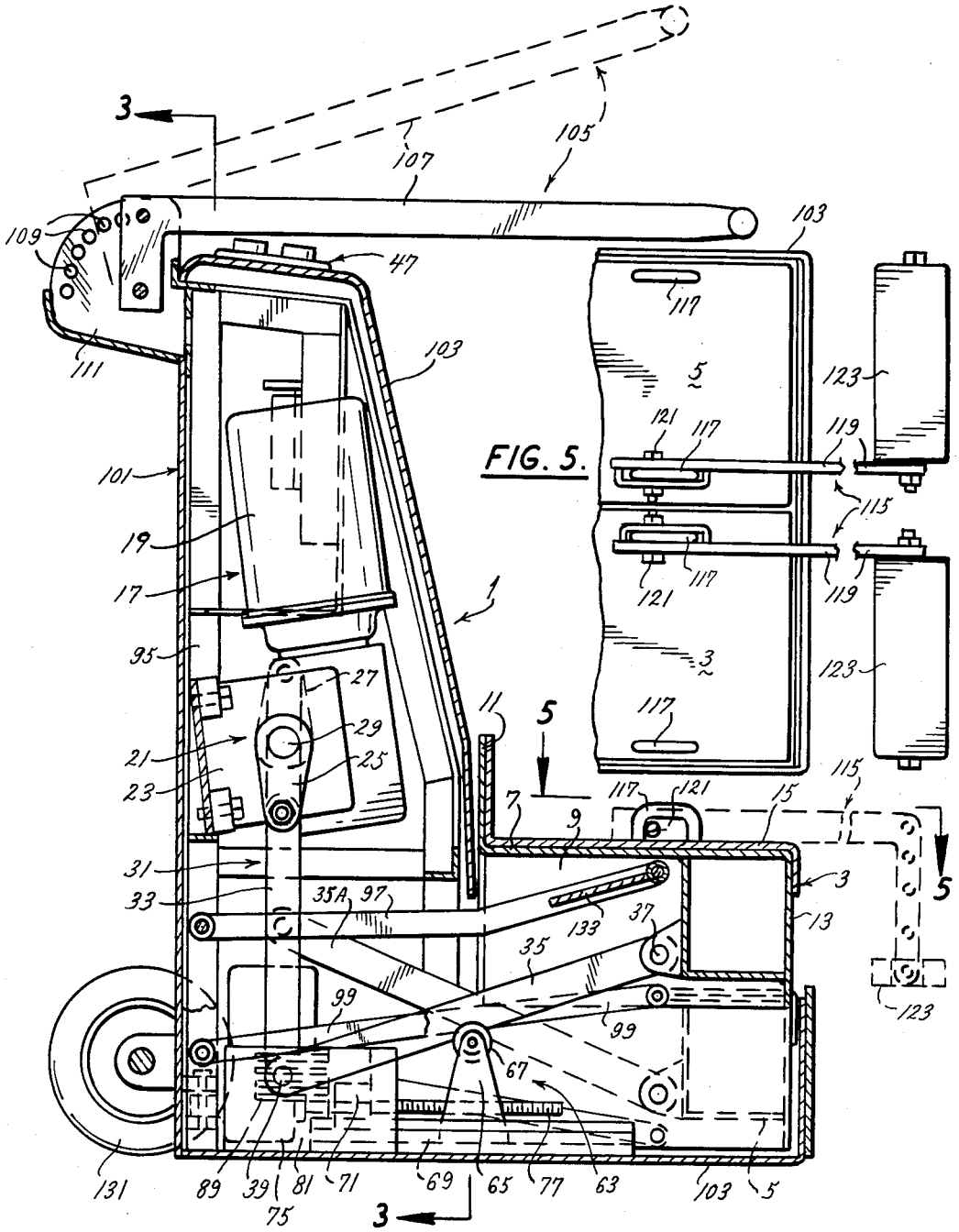
FIG. 2 is a sectional elevational view of the machine.
FIG. 5 is a fragmentary plan view taken on line 5—5 of FIG. 2.
Figure 3:
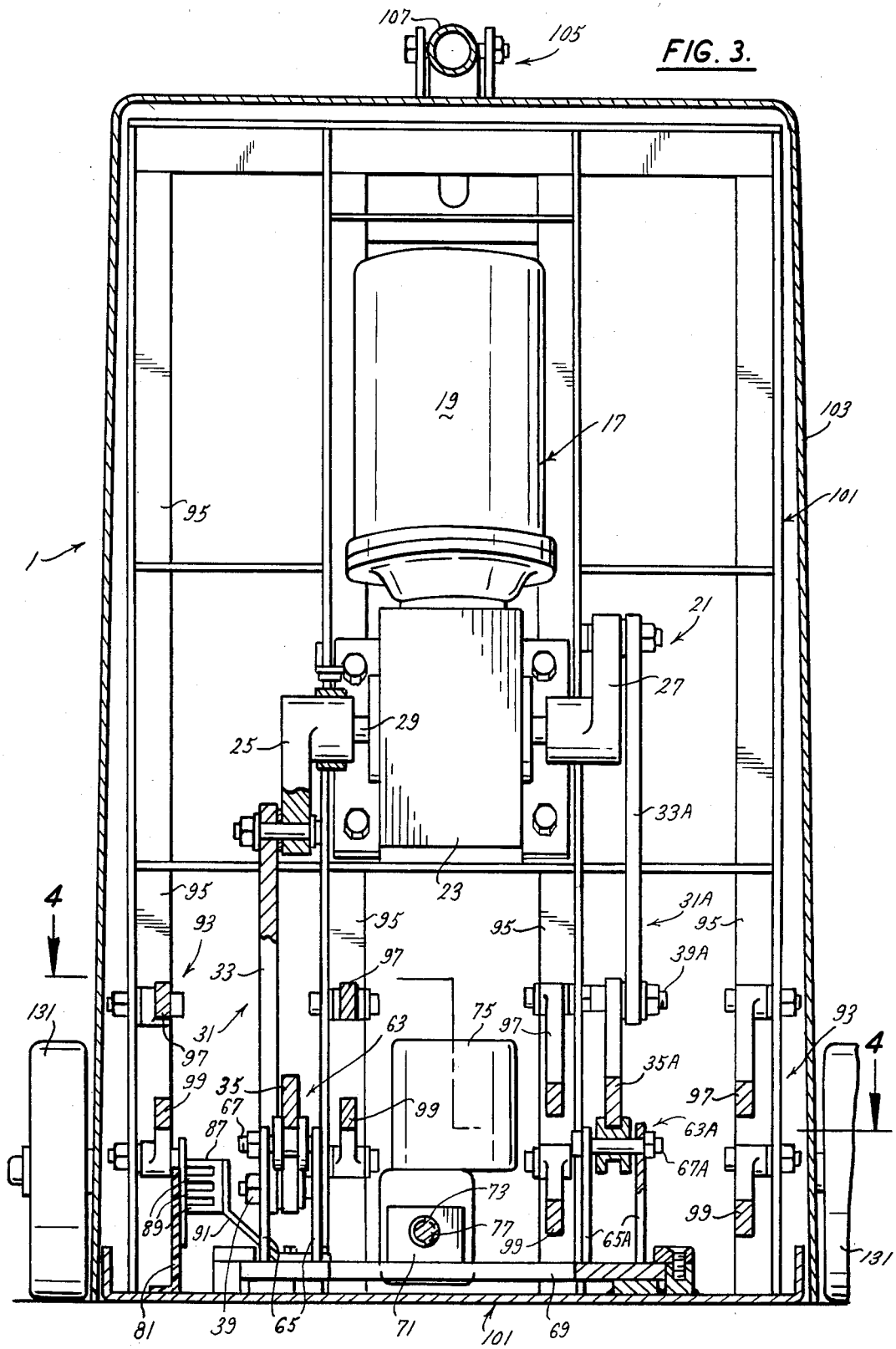
FIG. 3 is a sectional view taken on line 3—3 of FIG. 2.

Referring now to the drawings and first to FIGS. 1–3, the apparatus of the present invention is indicated generally by the numeral 1 and is for providing a person physical exercise. As will be described, the apparatus works by rhythmically shifting a person's weight from one side to the other. The apparatus includes first and second foot pads 3 and 5 respectively. A person using the apparatus places a foot on each respective pad. Both pads are capable of supporting a substantial portion of the person's weight. Each pad comprises a flat top plate 7 with opposed side plates 9 on the underside of the plate. The forward end of plate 7 has an upturned lip 11 and the rearward end of the plate a downturned lip 13. A non-slip stairtread pad 15 is attached to the top of plate 7 to provide a comfortable rest for the person's feet.

The apparatus further includes a drive means 17 operable by the user of the apparatus. Means 17 includes an electric motor 19 with crank assembly 21 driven by the motor. Assembly 21 is connected to the motor 19 by a gear drive 23 and the assembly includes crank arms 25 and 27 arranged 180° apart on opposite ends of an output shaft 29 of the gear drive.

A linkage means indicated generally by 31 connects the drive means with the foot pads to raise and lower the pads. With respect to foot pad 3, for example, linkage means 31 includes a first lever arm 33 one end of which is pivotally or rotatably connected to crank arm 25 and a second lever arm 35 which is pivotally connected to foot pad bracket indicated at 37. The other ends of arms 33 and 35 are interconnected by a pin 39 so the lever arms are free to rotate with respect to each other. Similarly, a linkage assembly 31A connects crank arm 27 with foot pad 5 via lever arms 33A and 35A. With crank arms 25 and 27 arranged 180° out-of-phase or apart from each other, the actuation of motor 19 produces a simultaneous raising of one foot pad and lowering of the other. This see-saw action of the foot pads causes the weight of the person standing on the foot pads to shift from one foot to the other. The step-like movement results in the user exercising his body to promote muscle tone and cardiovascular fitness.

Figure 7:
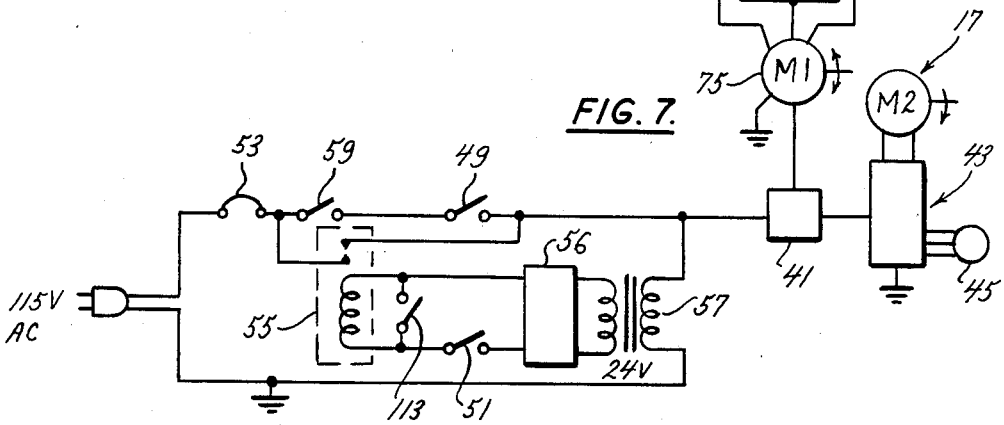
FIG. 7 is a schematic circuit diagram.
Figure 9:
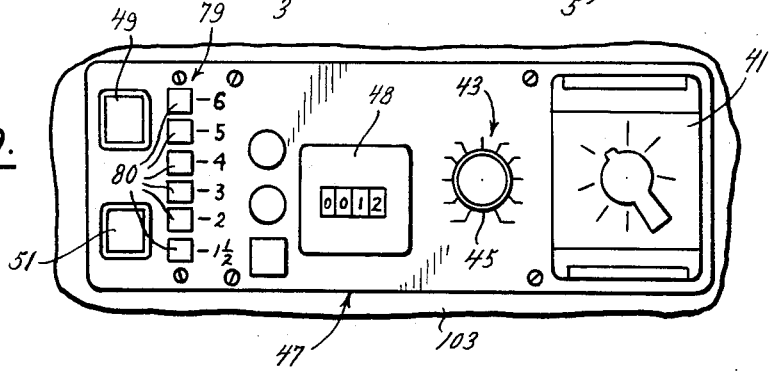
FIG. 9 is a fragmentary view showing the control panel.

The amount of exercise a person obtains is a function of the length of time a person exercises, the number of times the pads are raised and lowered during that period and the amount by which the pads are raised and lowered. As shown in FIGS. 7 and 9 a mechanical timer 41 whose operation is well known in the art is adjustable by the person using the apparatus to determine the length of an exercise period. A motor speed control 43 is also adjustable by the person to control the number of times the foot pads are raised and lowered during a given period. Speed control 43 includes a silicon controlled rectifier ("SCR") type of speed control. Operation of the SCR to control motor speed is well known in the art and will not be described in detail. The SCR is used with a potentiometer 45 whose setting is adjustable by the user. Both timer 41 and potentiometer 45 are located on a control panel or console 47 by which the user can turn on and off the apparatus and control his or her amount of exercise. In use, timer 41 may be settable to, for example, a maximum of one hour, and potentiometer 45 may, for example, be adjustable to 120 steps per minute. A counter 48 is provided on the console to count the steps. Also includes on console 47 are an "on" switch 49 and an "off" switch 51. In use, 115 volt A.C. power is routed to motor 17 through a circuit breaker 53, switch 49, a power relay 55, switch 51, a bridge rectifier 56, a transformer 57, and motor speed control 43. Latching and unlatching of relay 55 is controlled by switches 49 and 51; while the current to motor 17 is controlled by speed control 43. Potentiometer 45 includes a normally open switch 59 which is in-line with "on" switch 49 and is normally open for safety reasons. Closure of switches 19, 51 and 59 turns motor 17 on.

Figure 4:
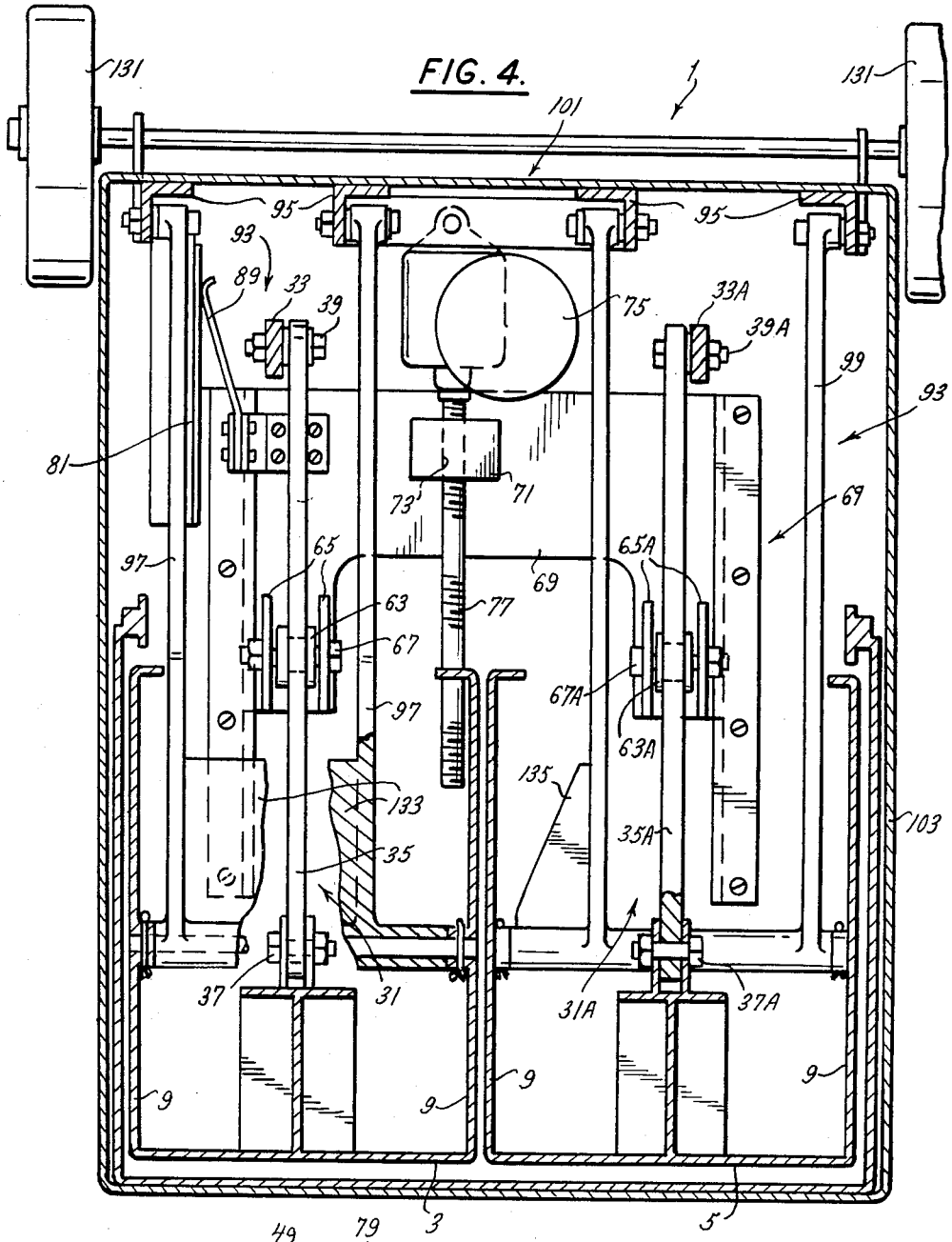
FIG. 4 is a sectional plan view taken on line 4—4 of FIG. 2.

The third component is determining the amount of exercise a person obtains, i.e. the amount by which the pads are raised and lowered is determined by a pivot means indicated generally by 61 (FIG. 4). Pivot means 61 includes a movable pivot 63 and 63A contacting the respective linkage or lever arms 35 and 35A. Pivots 63 and 63A each comprise a pair of brackets 65 and 65A which are spaced apart and have a pin 67 or 67A respectively inserted between them. Lever arms 35 and 35A respectively bear against the upper portion of pins 67 and 67A thus for the pins to act as a fulcrum or pivot point for the lever arms. Pivots 63 and 63A are mounted atop the arms of a U-shaped plate 69. A block 71 on top of the base portion of plate 69 has a longitudinal threaded bore 73 which parallels the arms of the plate. Pivot means 61 further includes a reversible d.c. motor 75 and a threaded screw 77 driven by the motor. Screw 77 is threaded through bore 73 in block 71 as to move plate 69 and pivot 63 and 63A in a direction determined by the directin of motor 75 rotation.

The point on lever arms 35 and 35A where they contact pivots 63 and 63A determine the amount foot pads 3 and 5 are raised and lowered. The closer to the footpads the contact is made the less the amount of vertical movement while the further away from the footpads contact is made, the greater the vertical movement. To facilitate the user determining the degree of vertical movement, and consequently the amount of exercise, console 47 has a set 79 of pushbuttoms 80 by which he can preset the amount of vertical movement. Set 79 may, for example, include six pushbuttons 80 by which the amount of vertical movement can be set from, for example, 1½" to 6" with intermediate settings of 2", 3", 4" and 5". By selecting an appropriate pushbutton 80 the user closes switches which complete an electrical circuit for motor 75. The motor is driven in the appropriate direction to turn lead screw 77 and move plate 69. Pivots 63 and 63A are correspondingly moved so to contact lever arms 35 and 35A respectively at new points. This shifts the fulcrum of the lever arms and changes the amount by which foot pads 3 and 5 are raised and lowered.

A printed circuit ("PC") board 81 is located adjacent plate 69. The PC board has a plurality of electrical circuit paths 83 etched thereon. Each path has a gap 85 at a point corresponding to a respective pushbutton switch position. a contact comb 87 has a plurality of tines 89 which press against the PC board and make electrical contact with the circuit paths. Contact comb 87 is fixed to the outer end of a bracket arm 91. The other end of the bracket arm is attached to plate 69 so the contact comb moves with the plate when motor 75 is energized. In addition, a limit switch is located at each end of the PC board.

In operation, the user pushes one of the pushbuttons 80 to select the height he wishes the foot pads to be raised and lowered. This closes an electrical circuit through motor 75. If the height selected requires the motor to be driven in one direction, the circuit is completed through one set of the pushbutton switch contacts. If the height selected requires the motor to be driven in the opposite direction, the circuit is completed through another set of pushbutton switch contacts. If the height selected is the previously selected height, no circuit is completed and the motor is not energized.

Upon energization, motor 75 turns screw 77 to move plate 69 in the appropriate direction. The tines of contact comb 87 move over the electrical circuit paths etched in PC board 81. When the timer 89 associated with the circuit path selected by the selected pushbutton switch reaches the gap 85 in the path, the electrical circuit is broken and the motor stops. At that point, plate 69 will have been moved to the point where pivots 63 and 63A contact lever arms 35 and 35A to provide the selected amount of upward and downward movement of foot pads 3 and 5. If either the highest or lowest height has been selected, plate 69 is driven by screw 77 until the appropriate limit switch at one end of the PC board is reached, at which time the circuit for motor 75 is broken.

To insure the foot pads move properly, and to prevent possible injury to a user, apparatus 1 further includes a guide means 93 for the foot pads. Apparatus 1 includes a frame 101 which includes four vertical support members 95, two of which are located on the same side of the apparatus as foot pad 3 and two of which are located on the same side of the apparatus as foot pad 5. A first or upper guide arm 97 has one end attached to a support member 95 and its other end attached to the upper portion of the respective foot pad side plate 9. Similarly, a second or lower guide arm 99 has one end attached to the support member at a point below the upper guide arm, and the other end of this second guide arm is attached to the respective foot pad side plate 9 at a lower part of the pad. Thus, each foot pad has four associated guide arms, two on each side of the pad, with two guide arms being at the upper end of the pads and two being at the lower end of the pads. The guide arms are rotatably connected to both the support members and the foot pads so to insure free vertical movement of each pad. The quadrilateral guide assembly produced by the four guide arms provide a pantograph-type motion producing substantially vertical movement of foot pads 3 and 5. The upper guide arms 97 are stiffened as by cross plates 133 and the lower guide arms 99 are stiftened by bracket 135 to prevent side-to-side movement of the pads.

The various components of apparatus 1 so far described are enclosed in an L-shaped cover 103 which has appropriate openings to accommodate the foot pads. Console 47 is located at the top of the cover so to be easily seen and reached by a person using the apparatus. The apparatus a frame 101 includes various horizontal and vertical support members including vertical support members 95 to provide structural support for the apparatus. Cover 103 fits over the frame and wheels 131 are attached to the rear corner of the frame 101 to provide the apparatus with mobility.

Apparatus 1 includes a grip means 105 to aid the user in working with the apparatus. The grip means includes a T-shaped handlebar assembly 107, the cross piece of which is sized to be easily gripped by the user. The stem of the handlebar fits in one of a series of openings 109 in a bracket 111 located at the upper rear portion of cover 101. The user can move the handlebar position to any of a series of positions until he finds the one most comfortable. The handlebar assembly also includes a switch 113 which can disrupt the electrical circuit to motor 17. Switch 113 is a tapeswitch and is normally closed. If, during exercise, the user begins to feel ill or unduly stressed, they can use the switch to deactivate the apparatus and prevent injury.

While the typical user of the apparatus may be able to stand on the foam pads while exercising, bed-ridden or other feeble persons may not be able to. To enable these people to use the apparatus, the apparatus includes enabling means 115. Foot pads 3 and 5 each include a pair of inverted U-shaped cleats 117 arranged in parallel on the sides of the respective pads. A pedal stirrup attachment 119 is secured by the inside cleats 117 to the foot pads. Each attachment is L-shaped with a pin or dowel 121 which secures the attachment to the foot pad. An adjustably mounted foot rest bicycle-type pedal 123, at the other end of the stirrup attachment, accommodates a seated person's feet. Thus, a person can sit down and still use the apparatus to get exercise. Alternatively, the inside and outside cleats 117 on each pad can be provided with straps 125 to hold a seated person's feet on the pads.

What has been described is an apparatus for obtaining physical exercise. The apparatus is usable by people in various stages of health and can be set to provide varying degrees of exercise.

We claim as our invention:

1. Apparatus providing a person physical exercise by shifting the person's weight from one foot to the other, the apparatus comprising:

(a) first and second foot pads on which a person stands, the person placing one of their feet on each respective pad with each pad being capable of supporting a substantial portion of the person's weight, (b) drive means operable by the person, (c) linkage means connecting the drive means to the pads to raise and lower each pad, each pad being moved simultaneously and in the opposite direction of the other pad whereby movement of the pads shifts the person's weight from one foot to the other, and (d) pivoting means acting with the linkage means to adjust the amount of upward and downward movement of the foot pads and thereby the amount of exercise of the person.

2. The apparatus of claim 1 wherein:

(e) the drive means comprises an electric motor and a crank means driven by the motor.

3. The apparatus of claim 2 wherein:

(f) the linkage means comprises a first linkage interconnected with the first foot pad and the crank means at one end of the shaft and a second linkage interconnected with the second foot pad and the crank means at the other end of the shaft.

4. The apparatus of claim 3 wherein:

(g) the crank means at the ends of the motor shaft are arranged 180° out-of-phase so the foot pads move in opposite directions when the motor is running.

5. The apparatus of claim 4 further including:

(h) timing means controlling operation of the motor to run the motor for a period determined by the person exercising.

6. The apparatus of claim 1 wherein:

(e) the linkage means includes an arm connected to each foot pad and the pivoting means includes a movable pivot contacting each respective linkage arm, the contact point on each linkage arm determining the height each foot pad is raised and lowered.

7. The apparatus of claim 1 further including:

(e) guide means for guiding movement of the foot pads.

8. The apparatus of claim 7 wherein:

(f) the guide means includes first and second guide arms attached to each side of each foot pad to produce a quadrilateral guide assembly for each pad which facilitates up and down movement of the pad and prevents side-to-side movement thereof.

9. The apparatus of claim 8 further including;

(g) a frame having frame members to which the guide arms are rotatably connected.

10. The apparatus of claim 1 further including:

(e) grip means to aid the person using the machine.

11. The apparatus of claim 10 wherein:

(f) the grip means includes a handlebar assembly gripped by the person using the apparatus, the assembly being adjustable to a position comfortable during use.

12. The apparatus of claim 11 wherein:

(g) the drive means includes an electric motor and the grip means further includes a switch controlling operation of the motor carried on the handlebar whereby the person gripping the handlebar can control operation of the apparatus.

13. The apparatus of claim 1 further including:

(e) means for enabling a person unable to stand to use the apparatus for exercise.

14. The apparatus of claim 13 wherein:

(f) the enabling means includes a pedal attachable to each foot pad whereby a person may sit in a chair or the like, place their feet on the peddle and have them raised and lowered as the foot pads are raised and lowered.

15. The apparatus of claim 1 including:

(e) a pair of wheels attached to the frame to provide mobility to the apparatus.

16. Apparatus providing a person physical exercise by shifting the person's weight from one foot to the other, the apparatus comprising:

(a) first and second foot pads on which a person stands, the person placing one of their feet on each respective pad with each pad being capable of supporting a substantial portion of the person's weight, (b) drive means operable by the person, (c) linkage means connecting the drive means to the pads to raise and lower each pad, each pad being moved simultaneously and in the opposite direction of the other pad whereby movement of the pads shifts the person's weight from one foot to the other, the linkage means including an arm connected to each foot pad; and (d) pivoting means acting with the linkage means to adjust the amount of upward and downward movement of the foot pads and thereby the amount of exercise of the person, the pivoting means including a movable pivot contacting each respective linkage arm with the contact point on each linkage arm determining the height each foot pad is raised and lowered, and a reversible electric motor and a lead screw driven by the motor, the lead screw moving the movable pivot in a direction determined by motor rotation.

17. The apparatus of claim 16 wherein:

(e) the pivoting means further includes a set of switches settable by the person exercising, each switch in the set representing a different height to which the foot pads are raised and lowered.

18. The apparatus of claim 17 further including:

(f) motor control means for shutting off the motor when it has driven the movable pivot to the point where the movable pivot contacts the arm so the foot pad is raised and lowered an amount indicated by the switch setting.

19. The apparatus of claim 18 wherein:

(g) the motor control means includes a printed circuit board having a plurality of electrical circuit paths contained thereon, each path having a gap therein at a point corresponding to a respective switch position.

20. The apparatus of claim 19 wherein:

(h) the motor control means further includes a contact comb movable by the lead screw, the comb having a plurality of tines each of which makes electrical contact with one of the circuit paths on the printed circuit board to complete an electrical circuit to run the motor, the motor continuing to run, once started, until the tine on the particular circuit path through which the motor is being powered reaches the gap in the path.

* * * * *

UNITED STATES PATENT AND TRADEMARK OFFICE

CERTIFICATE OF CORRECTION

PATENT NO. : 4,676,501

DATED : June 30, 1987

INVENTOR(S) : Daniel A. Hoagland and Michael J. Amoroso

It is certified that error appears in the above-identified patent and that said Letters Patent are hereby corrected as shown below:

Column 3, line 25 delete "19" and insert --49--.
Column 3, line 45 delete "directin" and insert --direction--.
Column 4, line 27 delete "89" and insert --41--.
Column 6, line 27 after "assembly" insert --which produces a pantograph type motion--.

Signed and Sealed this

Tenth Day of November, 1987

*Attest:*

DONALD J. QUIGG

*Attesting Officer*

*Commissioner of Patents and Trademarks*